US008973218B2

(12) United States Patent
Yabukoshi et al.

(10) Patent No.: US 8,973,218 B2
(45) Date of Patent: Mar. 10, 2015

(54) ORIGINAL COVER CLOSER AND OFFICE EQUIPMENT HAVING THE SAME

(71) Applicant: Kem Hongkong Limited, Kowloon (HK)

(72) Inventors: Kentaro Yabukoshi, Kanagawa (JP); Tetsuo Kondo, Kanagawa (JP)

(73) Assignee: Kem Hongkong Limited, Tsimshatsui Kowloon (HK)

( * ) Notice: Subject to any disclaimer, the term of this patent is extended or adjusted under 35 U.S.C. 154(b) by 0 days.

(21) Appl. No.: 14/159,620

(22) Filed: Jan. 21, 2014

(65) Prior Publication Data

US 2014/0201946 A1 Jul. 24, 2014

(30) Foreign Application Priority Data

Jan. 18, 2013 (JP) ..... 2013-007332

(51) Int. Cl.
*E05F 1/08* (2006.01)
*E05F 1/12* (2006.01)
*E05D 3/12* (2006.01)

(52) U.S. Cl.
CPC ..... *E05F 1/1261* (2013.01); *E05Y 2900/608* (2013.01); *E05D 3/12* (2013.01); *E05Y 2201/638* (2013.01); *E05Y 2800/73* (2013.01)
USPC ..... 16/286; 16/281; 16/282

(58) Field of Classification Search
USPC ..... 16/281, 282, 284, 286, 287, 294, 304, 16/311, 325–326, 327, 352
See application file for complete search history.

(56) References Cited

U.S. PATENT DOCUMENTS

| | | | | |
|---|---|---|---|---|
| 5,926,917 | A * | 7/1999 | Gantz | 16/334 |
| 6,353,965 | B1 * | 3/2002 | Lo | 16/228 |
| 6,684,456 | B2 * | 2/2004 | Lee | 16/342 |
| 6,886,220 | B2 * | 5/2005 | Kuramochi | 16/286 |
| 7,724,405 | B2 * | 5/2010 | Kondo | 358/487 |
| 8,813,311 | B2 * | 8/2014 | Li | 16/286 |

FOREIGN PATENT DOCUMENTS

| | | |
|---|---|---|
| JP | 11-095339 A | 4/1999 |
| JP | 2008-224704 A | 9/2008 |

* cited by examiner

*Primary Examiner* — Roberta Delisle
(74) *Attorney, Agent, or Firm* — Griffin & Szipl, P.C.

(57) ABSTRACT

To provide an original cover closer which prevents inner components from exposure to the outside, when the original cover is opened, and from smears of grease on the end of the original lying on the contact glass, the original cover closer comprises the attaching member, the supporting member assembled by rotatably coupling its own both side plates to the both side plates of the attaching member, the lifting member assembled by rotatably coupling its own both side plates to the both side plates of the supporting member, the pressure bearing member provided between the both side plates of the attaching member, a second slider in contact with the pressure bearing member, and slidably housed between the both side plates of the supporting member; an actuating member attached to the side on which the both side plates of the attaching member rotate via said second hinge pin; a first slider in contact with the actuating member, held by the holding pieces and slidably housed between the both side plates of said supporting member, and a compression coil spring resiliently provided between the first slider and the second slider, wherein a cover member is fixed to the supporting member, for covering at least in part areas of components such as the actuating member, the first slider and the second slider which are exposed to the outside.

8 Claims, 18 Drawing Sheets

ORIGINAL COVER CLOSER AND OFFICE EQUIPMENT HAVING THE SAME

This application claims priority to Japanese application 2013-007332, filed Jan. 18, 2013, the entire disclosure of which is incorporated herein by reference.

FIELD OF THE INVENTION

The present invention relates to an original cover closer suitable in use for office equipment including a copying machine, a printer, a facsimile, a scanner, and the like; it further relates to office equipment provided with the mentioned automatic original cover closer.

BACKGROUND ART

An original cover is attached via original cover closers to a main body of office equipment such as a copying machine, a printer, a facsimile, a scanner. Each original cover closer is a kind of hinge mechanism, of which the layout is as disclosed in JP Laid-Open Patent Application H11-95339: it comprises an attaching member comprising a bottom plate attached to the main body of office equipment; both side plates erected from both sides of the bottom plate; a supporting member comprising an upper plate and both side plates provided to hang down perpendicular to both sides of the upper plate, wherein the supporting member is assembled by rotatably coupling its both side plates to the both side plates of the attaching member via a first hinge pin; a lifting member comprising an upper plate attached to the original cover and both side plates provided to hang down perpendicular to both sides of the upper plate, wherein the both side plates of the lifting member are coupled to the free end side of the supporting member via a second hinge pin, such that the lifting member is rotatable in a direction opposite to the direction in which the supporting member rotates, an actuating member installed between the both side plates of the lifting member; a first slider which is in contact with the actuating member and housed between the both side plates of the supporting member, such that the first slider is slidable; a pressure bearing member provided between the both side plates of the attaching member; a second slider in contact with the pressure bearing member, wherein the second slider is housed between the both side plates of the supporting member, such that the second slider is slidable; and a compression coil spring resiliently provided between the first slider and the second slider.

When such a conventional original cover is opened, internal parts of an original cover closer, which are used for attaching the original cover to a main body, such that the original cover is openable and closable (in particular an actuating member, a first slider, a second slider, a pressure bearing member and a compression coil spring), will have parts exposed to the outside. A user can see such internal parts, so their appearance gives unfavorable impressions. Still further, lubricating grease and oil (as applied onto sliding contact surface of the actuating member and the first slider, that of the first slider and the supporting member, and that of the second slider and the supporting member, as well as onto an area corresponding to the compression coil spring) often smear ends of an original lying outside the contact glass, when the original is put on the contact glass for the purpose of scanning. Still further, when the original cover is attached to the main body in assembly, or detached from and attached to it during repair works, a worker often touches the original cover by hands or grasps it, and in this manner, a problem arises in that his hands are smeared with the grease and oil as mentioned above.

SUMMARY OF THE INVENTION

The present invention is made to solve the above-mentioned problems, and an object of the invention is to provide an original cover closer which is devised to prevent internal parts from exposure to the outside as much as possible, and to prevent grease and oil, as applied on such internal parts, from smearing ends of an original lying outside the contact glass, when the original is put on the contact glass for the purpose of scanning, as well as smearing hands of a user and/or a worker, when such persons are attaching the original cover closer to the main body and detaching from it.

To achieve the above-mentioned object, an original cover closer according to the present invention is intended for supporting an original cover of office equipment on a main body, such that the original cover is openable and closable with respect to the main body; it further comprises an attaching member comprising a bottom plate attached to the main body of office equipment and both side plates erected from both sides of the bottom plate; a supporting member comprising an upper plate, both side plates provided to hang down perpendicular to both sides of the upper plate and holding pieces provided by inwardly folding respective sections of the both side plates, wherein the supporting member is assembled by rotatably coupling its both side plates to the both side plates of the attaching member via a first hinge pin; a lifting member for being attached to the original cover, which comprises an upper plate attached to the original cover and both side plates provided to hang down perpendicular to both sides of the upper plate, wherein the both side plates of the lifting member are coupled to the free end side of the supporting member via a second hinge pin, such that the lifting member is rotatable in a direction opposite to the direction in which the supporting member rotates; a pressure bearing member provided between the both side plates of the attaching member; a second slider in contact with the pressure bearing member, which is held by the holding pieces and housed between the both side plates of the supporting member, such that the second slider is slidable, an actuating member attached to the side on which the both side plates of the lifting member rotate via the second hinge pin; a first slider in contact with the actuating member, which is held by the holding pieces and housed between the both side plates of the supporting member, such that the first slider is slidable; and a compression coil spring resiliently provided between the first slider and the second slider, and the original cover closer is characterized in that a cover member is fixed to the supporting member, for covering at least in part areas of the actuating member, the first slider and the second slider, which are exposed to the outside, as well as that of the compression coil spring which is exposed to the outside.

In that case, the invention is characterized in that attaching pieces are provided on both sides of a cover member in order to fix the cover member to a supporting member, and that the attaching pieces are attached to second hinge pins with edge portions of the attaching pieces being in contact with a lower surface of an upper plate of the supporting member.

Still further, in the invention, a cover member can be configured such that it is attached to an upper plate or both side plates of a supporting member through welding, attaching screws and rivet pins.

Still further, in the invention, a cover member can comprise a first cover portion covering a part on the side of an upper portion of a first slider and a part on the side of an upper portion of a second hinge pin, a second cover portion raised from the first cover portion and formed by folding a part of the first cover portion about 45°, a third cover portion raised from the second cover portion and formed by folding a part of the second cover portion about 90° relative to the first cover portion, and an attaching pieces formed by folding both end portions of the second cover portion, wherein the attaching pieces are attached to the second hinge pin.

Still further, in the invention, a cover member can comprise a first cover portion covering a part on the side of an upper portion of a first slider and a part on the side of an upper portion of a second hinge pin, a second cover portion formed by folding a part of the first cover portion substantially perpendicular to the first cover portion, which covers the compression coil spring, as is exposed to the outside from between the holding pieces, as well as from between the first slider and the second slider, and attaching pieces formed by folding both end portions of the first cover portion, wherein the attaching pieces are attached to the second hinge pin.

Still further, the present invention is intended for supporting an original cover of office equipment on a main body, such that the original cover is openable and closable with respect to the main body; it further comprises an attaching member comprising a bottom plate, a leg portion hanging down to a direction perpendicular to the bottom plate and capable of being inserted into an attaching hole provided on the main body, such that the leg portion is detachable from said attaching hole and attachable to the latter, and both side plates erected from both sides of the bottom plate; a supporting member comprising an upper plate, a top plate provided on one end of the upper plate, and both side plates provided perpendicular to both sides of the upper plate, and holding pieces provided by inwardly folding respective sections of the both side plates, wherein the supporting member is assembled by rotatably coupling its both side plates to the both side plates of the attaching member via first hinge pins; a lifting member comprising an upper plate attached to the original cover and both side plates provided perpendicular to both sides of the upper plate, wherein the both side plates of the lifting member are coupled to the free end side of the supporting member via second hinge pins, such that the lifting member is rotatable in a direction opposite to the direction in which the supporting member rotates, an actuating member installed between the both side plates of the lifting member; a first slider housed between the both side plates of the supporting member, such that the first slider is slidable, a pressure bearing member provided between the both side plates of the attaching member; a second slider in contact with the pressure bearing member, wherein the second slider is housed between the both side plates of the supporting member, such that the first slider is slidable; and compression coil springs resiliently provided between the first slider and the second slider, and the original cover closer is characterized in that a cover member is fixed to the supporting member, for covering at least in part sections of the actuating member, the first slider and the second slider which are exposed to the outside, as well as those of the compression coil springs which are exposed to the outside.

Furthermore, the invention relates to office equipment wherein an original cover comprising an original cover closer according to either of the above-mentioned aspects is used.

As stated above, according to the invention, the cover member can partially cover areas of components of the original cover closer, i.e. the second hinge pin, the actuating member, the first slider, the second slider, as are exposed to the outside, as well as an area of the compression coil spring, as is exposed to the outside. In this manner, the cover member can effectively prevent lubricating or anti-rust grease and oil (those applied onto such areas exposed to the outside) from smearing hands of a user opening and closing the original cover, or a worker attaching the original cover to the main body or detaching the former from the latter at the time of assembling and maintenance, as well as such grease and oil from smearing end of the original lying on the contact glass of the main body.

Still further, the cover member can prevent the second hinge pin, the actuating member, the first slider, a part of the second slider, and a compression coil spring (which are exposed to the outside, when the original cover is opened) from exposure to the outside, so that it can improve the aesthetics the original cover and assure upgrades to the original cover.

EMBODIMENTS

In the following reference is made to an original cover closer according to the present invention, as is applied to a copying machine being a sort of the office equipment, however, the original cover closer according to the present invention can be also used for a printer, a facsimile, a scanner, or a sort of office equipment called multifunctional device, or others.

Embodiment 1

Figure 1:
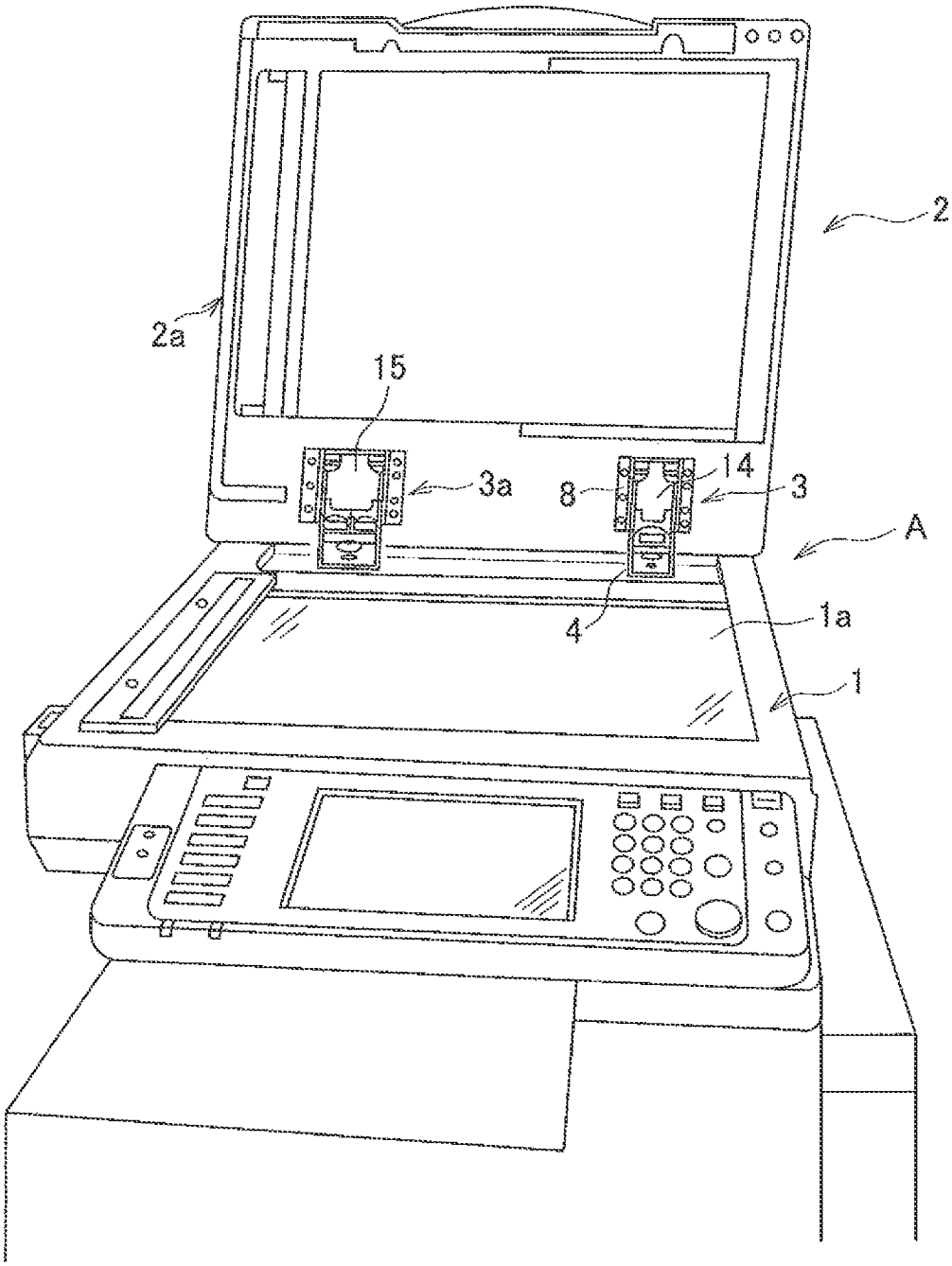
FIG. 1 is a perspective view of an original cover (in an opened state) of a copying machine which belongs to a category of the office equipment using an original cover closer according to the present invention.
Figure 2:
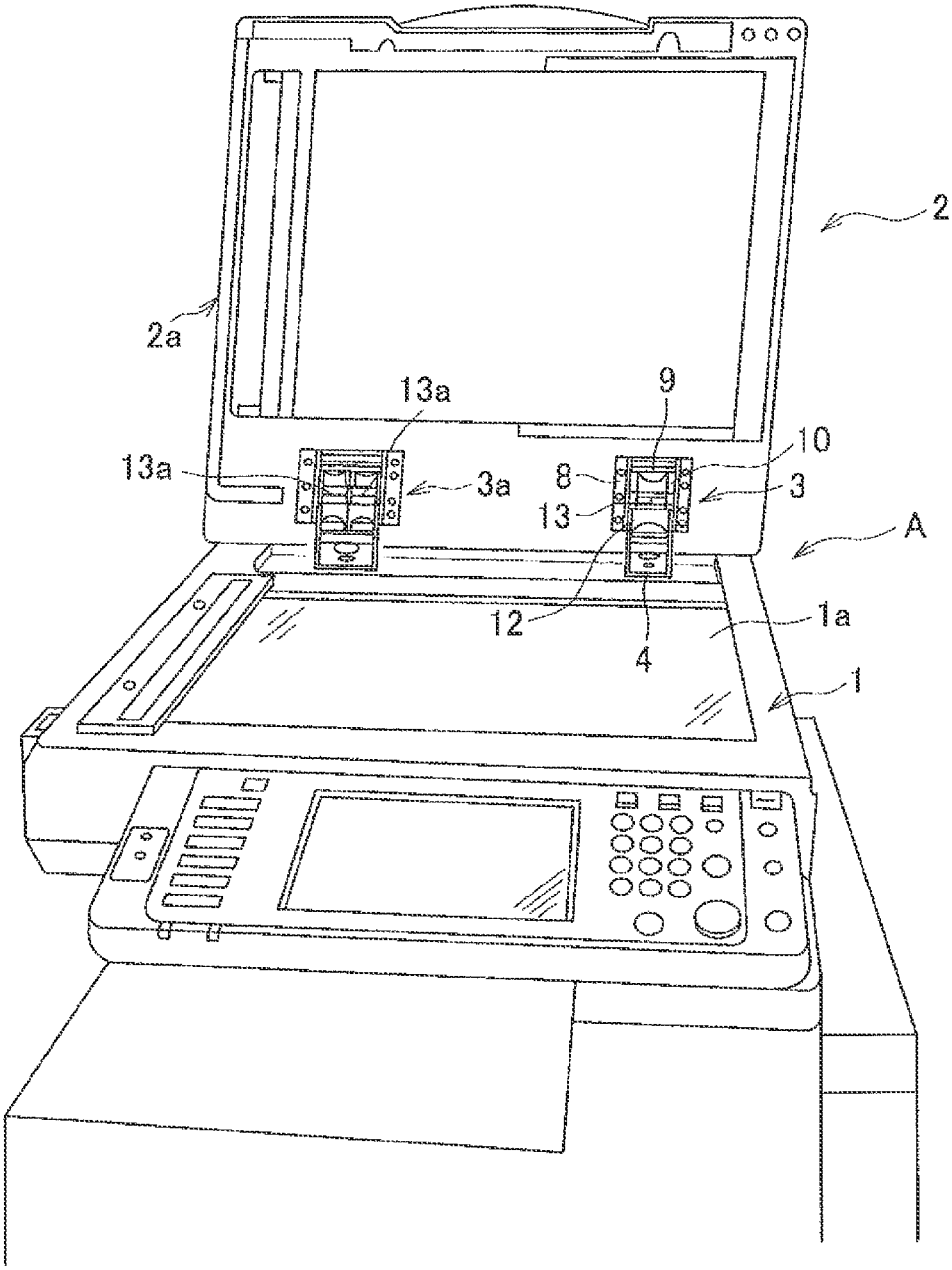
FIG. 2 is a perspective view of a copying machine as shown in FIG. 1 from which a cover member of an original cover closer is removed.
Figure 3:
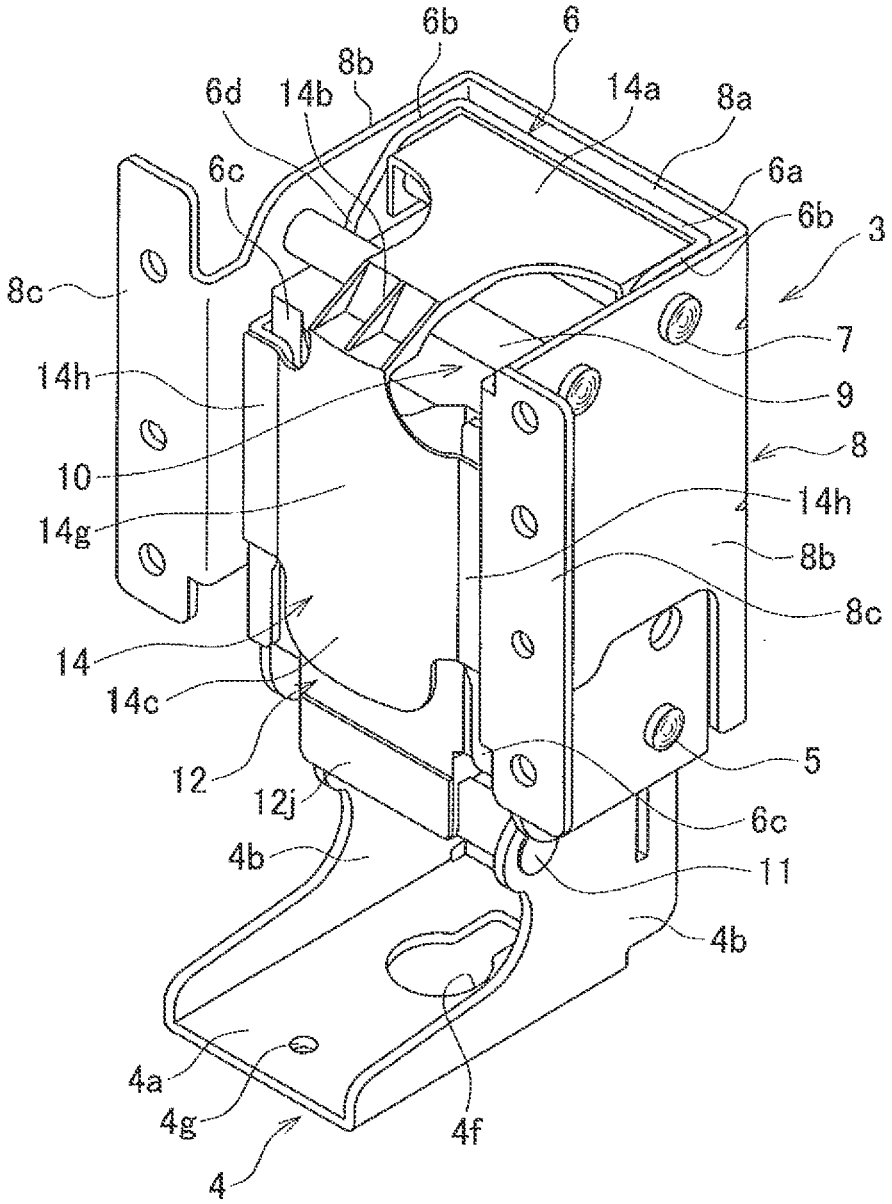
FIG. 3 is a perspective view of an example of an original cover closer according to the present invention.
Figure 4:
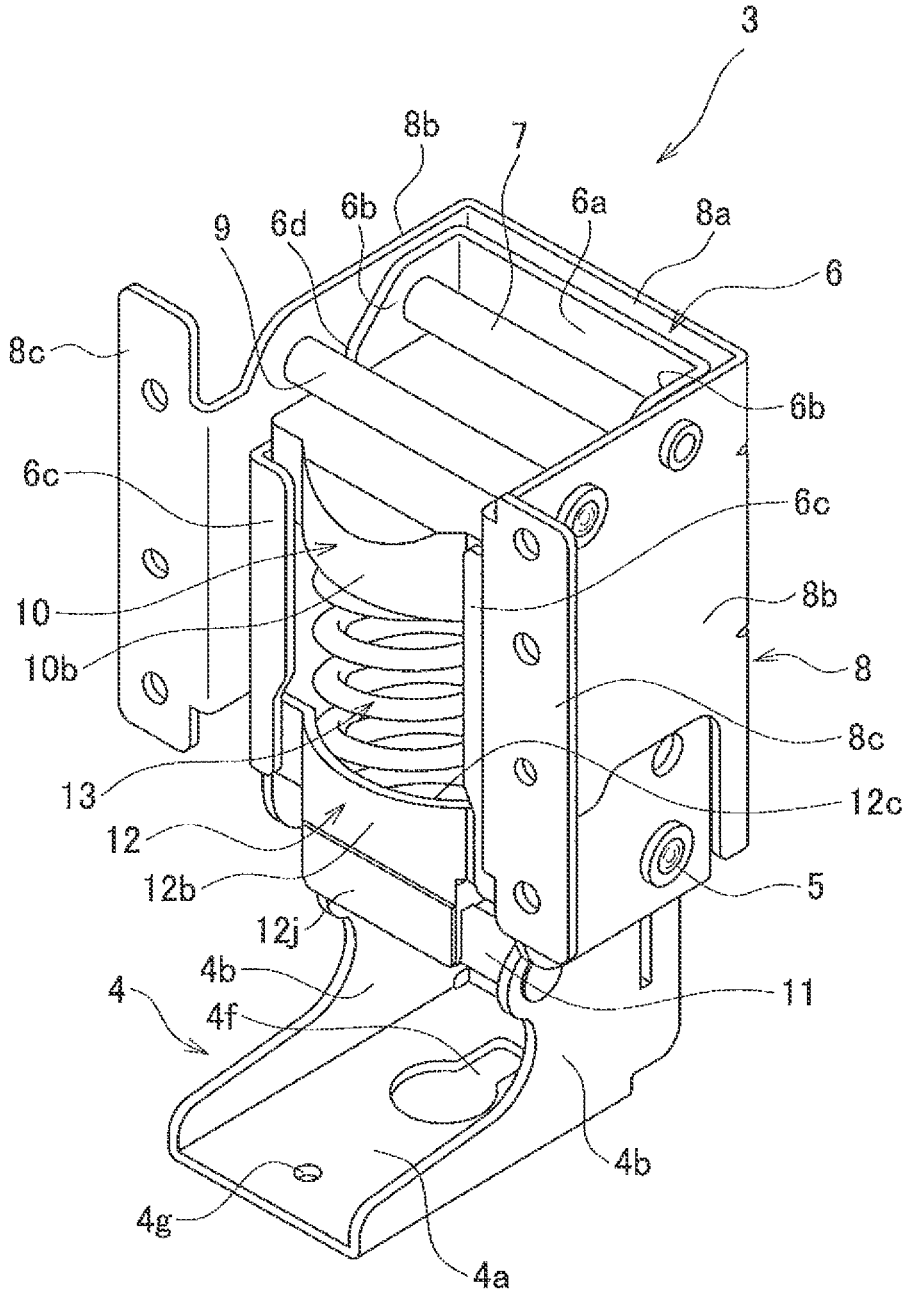
FIG. 4 is a perspective view of an original cover closer according to the present invention as shown in FIG. 3 from which a cover member is removed.

FIGS. 1 and 2 show a copying machine A which uses an original cover closer 3 according to the present invention. Of the figures, FIG. 1 shows the original cover closer to which cover members 14 and 15 are attached, while FIG. 2 shows the original cover closer without cover members 14 and 15 being attached thereto. If one observes FIG. 2 as above described, one can understand that internal components of the original cover closer 3 (an actuating member 9, a first slider 10, a second slider 12 and compression coil springs 13 or 13*a*, and others) are exposed to the outside. The same applies to an original cover closer 3*a*, wherein no reference numerals are given to the corresponding parts.

According to the drawings, a copying machine A being a sort of office equipment comprises a main body 1, and an original cover 2. An original cover closer 3 according to the present invention is a sort of hinge mechanism for attaching the original cover 2 to the main body 1 of the copying machine A, such that the original cover is openable and closable with respect to the main body. Original cover closers are normally used in pairs, and respectively attached to the right hand side and the left hand side of the original cover. In the following, reference is mainly made to the original cover closer 3 on the right hand side, but an original cover closer 3*a* on the left hand side can be also implemented in the same manner. Since the original cover closer 3*a* on the left hand side supports the original cover 2 on the side with an automatic original feeder 2*a*, which is heavier than the rest of the original cover 2, the original cover closer uses two compression coil springs 13*a*, 13*a* (as described below) side by side. However, the one on the left hand side as well has the common problem as in the original cover closer 3 on the right hand side, so it is necessary to implement the present invention to the original cover closer 3*a* on the left hand side.

FIGS. 3 to 16 show views of an original cover closer 3 on the right side hand of two original cover closers 3, 3*a* as shown in FIGS. 1 and 2. An original cover closer 3*a* on the left hand side has the same structure as the original cover closer 3 on the right hand side, except use of two compression coil springs 13*a*, 13*a* for the former original cover closer and the different dimensions for respective original covers.

As shown in the drawings, an original cover closer 3 according to the present invention comprises an attaching member 4 attached to a top end on a rear section of a main body 1 of a copying machine A, a supporting member 6 rotatably coupled via a first hinge pin 5 to the attaching member 4, a lifting member 8 coupled via a second hinge pin 7 to the supporting member 6, wherein the lifting member supports an original cover 2, an actuating member 9 fixed on the side of the second hinge pin 7 of the lifting member 8, a first slider 10 in contact with the actuating member 9, wherein the first slider is held by holding pieces 6*c*, 6*c* and housed between both side plates 6*b*, 6*b* of the supporting member 6, such that the first slider is slidable with respect to the both side plates, a pressure bearing member 11 provided at a position off-centered in a forward direction between the both side plates 4*b*, 4*b* of the attaching member 4, a second slider 12 in contact with the pressure bearing member 11, wherein the second slider is held by holding pieces 6*c*, 6*c* and housed between both side plates 6*b*, 6*b* of the supporting member 6, such that the second slider is slidable with respect to the both side plates, a compression coil spring 13 resiliently provided between the first slider 10 and the second slider 12, with a part of the compression coil spring being exposed to the outside, a cover member 14 being a separate member, which covers areas exposed to the outside of the above mentioned parts having such sections, and in particular of the compression coil spring 13.

Figure 7:
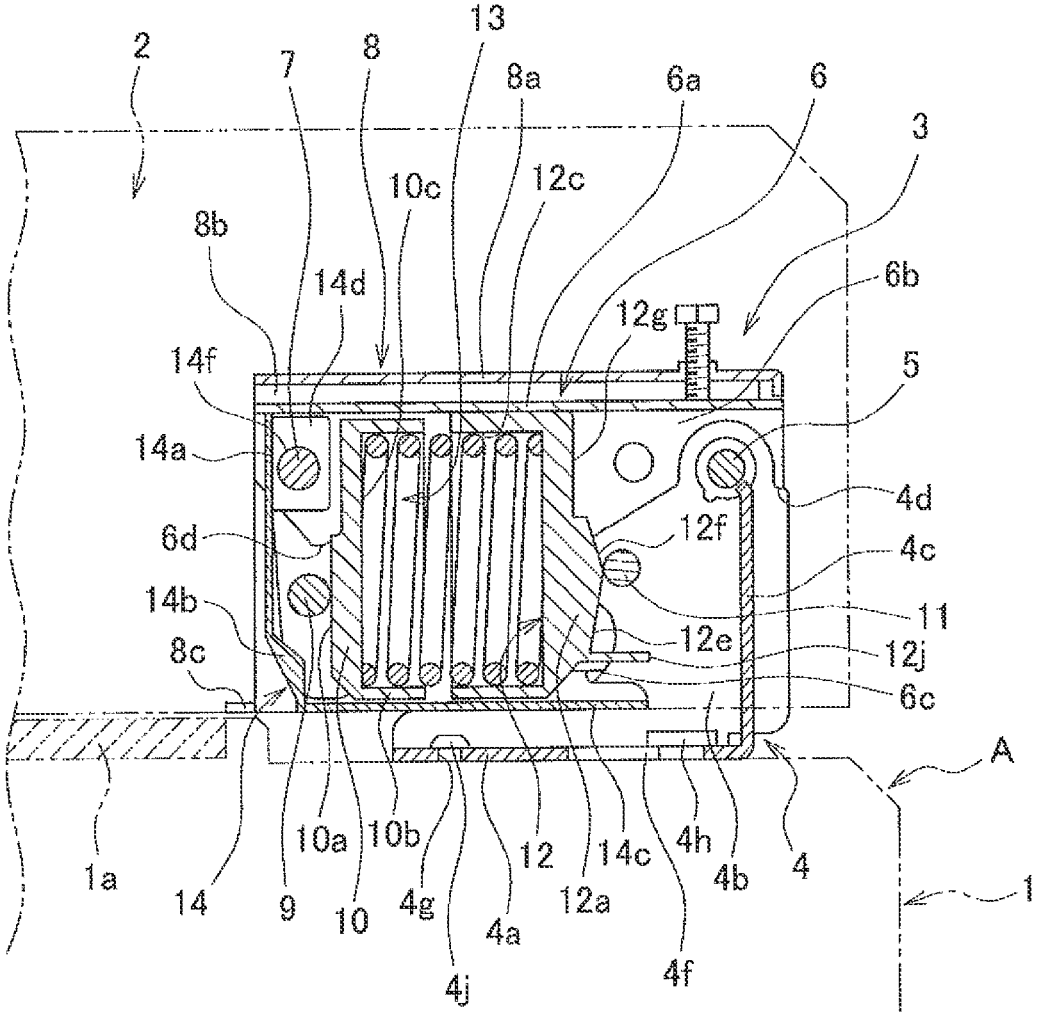
FIG. 7 is a side sectional view of an original cover closer as shown in FIG. 6.
Figure 8:
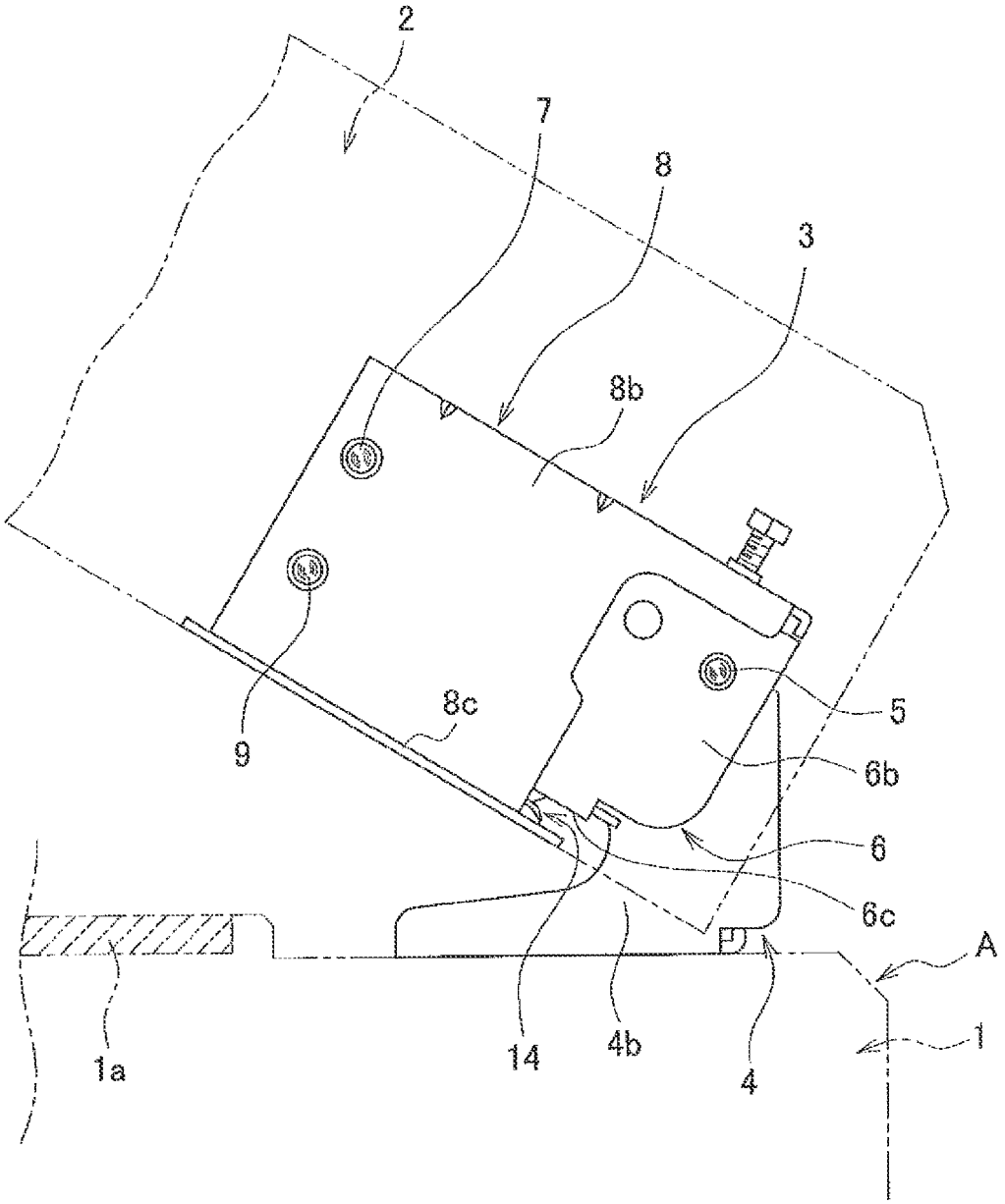
FIG. 8 is a side view showing an original cover closer according to the present invention as is used.

An attaching member 4 comprises a bottom plate 4*a* attached to a main body 1, both side plates 4*b*, 4*b* folded to a direction perpendicular to the bottom plate 4*a*, and a rear plate 4*c* having a substantially rectangular shape and extending from one end. (in particular from the right-hand end, as shown in FIG. 7) to a direction perpendicular to the bottom plate 4*a* (including a direction substantially perpendicular thereto).

A bottom plate 4*a* of an attaching member 4 has a substantially rectangular shape, wherein an attaching button member 4*h* is provided, as well as attaching holes 4*f*, 4*g* for attaching the attaching member to a main body 1 using attaching screws 4*j* and others. A pressure bearing member 11 according to the present embodiment is non-rotatably attached between both side plates 4*b*, 4*b* of the attaching member 4, but can be also rotatably installed between both side plates 4*b*, 4*b*. The pressure bearing member 11 is not particularly limited in its shape, but can be a shaft body having a circular cross section which is fixed between the both side plates 4*b*, 4*b*, with a cylindrical body being rotatably attached to its circumference, as in the present embodiment. The pressure bearing member 11 is in press contact with a cam portion 12*a* of a second slider 12 as described below, and lubricating grease (not shown) is applied to respective outer circumferences of the cam portion 12*a* and the pressure bearing member 11.

A supporting member 6 comprises an upper plate 6*a*, both side plates 6*b*, 6*h* folded at the both side end sections of the upper plate 6*a*, so as to hang down to a direction perpendicular to the upper plate 6*a*, holding pieces 6*c*, 6*c*, each of the holding pieces shaped by folding 90 each of the both side plates 6*b*, 6*b* at a lower end section in a direction of the side plate on the opposite side, and guide grooves 6*d*, 6*d* of an actuating member 9 is provided on the free end side of the both side plates 6*b*, 6*b*. The both side plates 6*b*, 6*b* are respectively located outside both side plates 4*b*, 4*b* of an attaching member 4, and rotatably coupled via a first hinge pin 5 to top ends on rear sections of the both side plates 4*b*, 4*b* of the attaching member 4.

A lifting member 8 has a substantially inversed T-shape as seen from the front side, and comprises an upper plate 8*a* to which a rear end side of an original cover 2 is attached using small screws and others, both side plates 8*b*, 8*b* folded downward at the both side end sections of the upper plate 8*a*, so as to hang down to a direction perpendicular to the upper plate 8*a*, and attaching plates 8*c*, 8*c*, each of the attaching plates shaped by folding downward each of the both side plates 8*b*, 8*h* at a lower end section. The lifting member 8 is located outside a both side plates 6*b*, 6*b* of a supporting member 6, and coupled via a second hinge pin 7 to tips of the both side plates 6*b*, 6*b*, to ensure that the both side plates 8*b*, 8*b* rotate toward the both side plates 6*b*, 6*b* of the supporting member 6, i.e. in a direction contrary to the one in which the supporting member 6 rotates with respect to an attaching member 4.

Still further, an actuating member 9 is attached to both side plates 8*b*, 8*b* of a lifting member 8 at a turning position with a second hinge pin 7 being a supporting point. The actuating member 9 is in press contact with a first slider 10 as described below. Further, lubricating grease (not shown) is applied to the actuating member 9 and a cam portion 10*a* of the first slider 10. According to this embodiment, the actuating member 9, having a round pin-like shape, is fixed between both side plates 8*b*, 8*b* of a lifting member 8, however, its shape is not limited to this embodiment. The actuating member 9 can be also rotatably installed, between the both side plates 8*b*, 8*b* of the lifting member 8, or formed by folding a section of an upper plate 8*a* or the both side plates 8*b*, 8*b*.

A first slider 10 and a second slider 12 in pairs are slidably housed between the respective inner sides of both side plates 6*b*, 6*b* of a supporting member 6, with respective slide portions 10*d*, 10*d*; 12*d*, 12*d* of the sliders being held by holding pieces 6*c*, 6*c*. The first slider 10 and the second slider 12 in pairs are bottomed cylindrical bodies; a curved portion 10*c* of the first slider 10 is provided so as to protrude from between the holding pieces 6*c*, 6*c*, and a curved portion 12*c* of the second slider 12 is provided in the same manner. Thus each slider is less thick in its entirety, so that saving in material is assured.

Moreover, a compression coil spring 13 is resiliently provided between a first slider 10 and a second slider 12 in pairs as described above, with both ends of the compression coil spring being received by a spring receiving portion 10*c* of the first slider 10 and a spring receiving portion 12*c* of the second slider 12. An intermediate part of the compression coil spring 13 is exposed to the outside from between the first slider 10 and the second slider 12, with anti-rust oil or grease being applied onto the surface of the intermediate part. As described above, the compression coil spring 13 urges the first slider 10 and the second slider 12 in a direction in which both sliders are spaced apart, which bring a cam portion 10*a* provided, on an end of the first slider 10 into press contact with an actuating member 9, and a cam portion 12*a* on an end of the second slider 12 into press contact with a pressure bearing member 11, in order to urge a lifting member 8 via an actuating member 9 to a direction in which the actuating member overlaps a supporting member 6. At the same time, the compression coil spring 13 urges as well the supporting member 6 and the lifting member 8 in an opening direction of an original cover 2.

A cam portion 12*a* of a second slider 12 comprises an upward inclined portion 12*e*, a downward inclined portion 12*f* provided in continuity with the upward inclined portion 12*e*, and a recessed flat portion 12*g* provided at a level slightly lower than the downward inclined portion 12*f* and in continuity with the latter. Moreover, escape recesses 12*h*, 12*h* are provided on both side portions of the cam portion 12*a*, for allowing both side portions of a first hinge pin 5 within a supporting member 6 to escape.

A cam portion 10*a* of a first slider 10 is composed of a flat portion raised toward a top (as assembled). Furthermore, a guard member 12*j* is provided so as to protrude from a leading end of an upward inclined portion 12*e* of a cam portion 12*a* of a second slider 12, for covering a surface of a pressure bearing member 11 relative to an attaching member 4.

Still further, a cover member 14 mainly covers a part of a compression coil spring 13 exposed to the outside, a body made of synthetic resin is preferable for such member in that an original cover 3 (or an original cover 3*a*) has an improved aesthetics and its upgrades are assured. However, material for the cover member is not limited to synthetic resin. The cover member 14 comprises a first cover portion 14*a* covering a part on the side of an upper portion of a first slider 10 and a part on the side of an upper portion of a second hinge pin 7, a second cover portion 14*b* raised from the first cover portion 14*a* and formed by folding a part of the first cover portion 14*a* about 45°, and a third cover portion 14*c* formed by folding a part of the second cover portion 14*b* about 90° relative to the first cover portion 14*a*. The third cover portion 14*c* thus covers the compression coil spring 13, where the latter is exposed to the outside, between holding pieces 6*c*, 6*c* of a supporting member 6, as well as between a first slider 10 and a second slider 12. In this manner, the cover member 14 is attached to the second hinge pin 7, with the latter being inserted into attaching holes 14*f*, 14*f* provided on attaching pieces 14*d*, 14*d* formed by folding both end portions of the first cover portion 14*a*.

Figure 5:
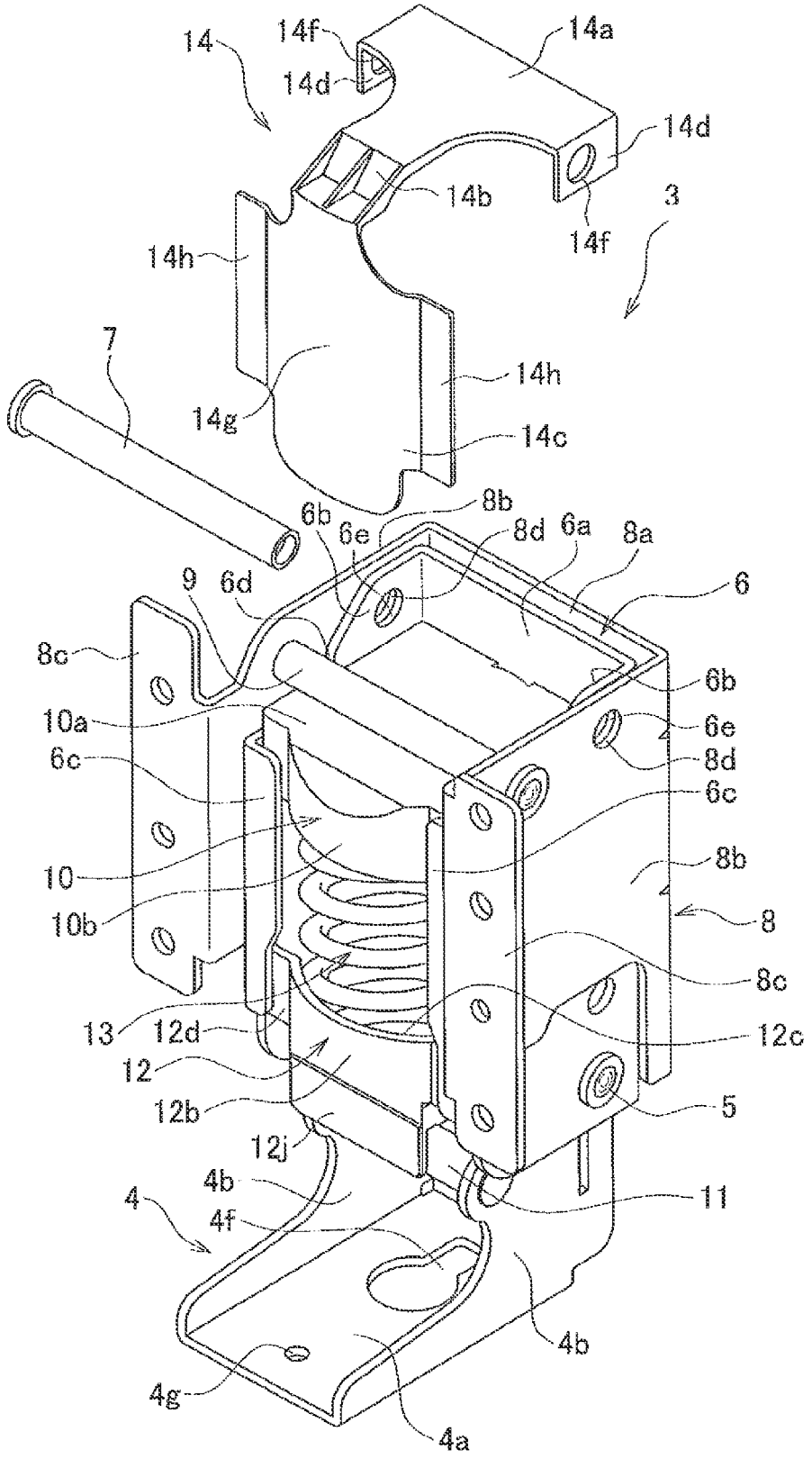
FIG. 5 is a partial exploded perspective view an original cover closer as shown in FIG. 3.
Figure 9:
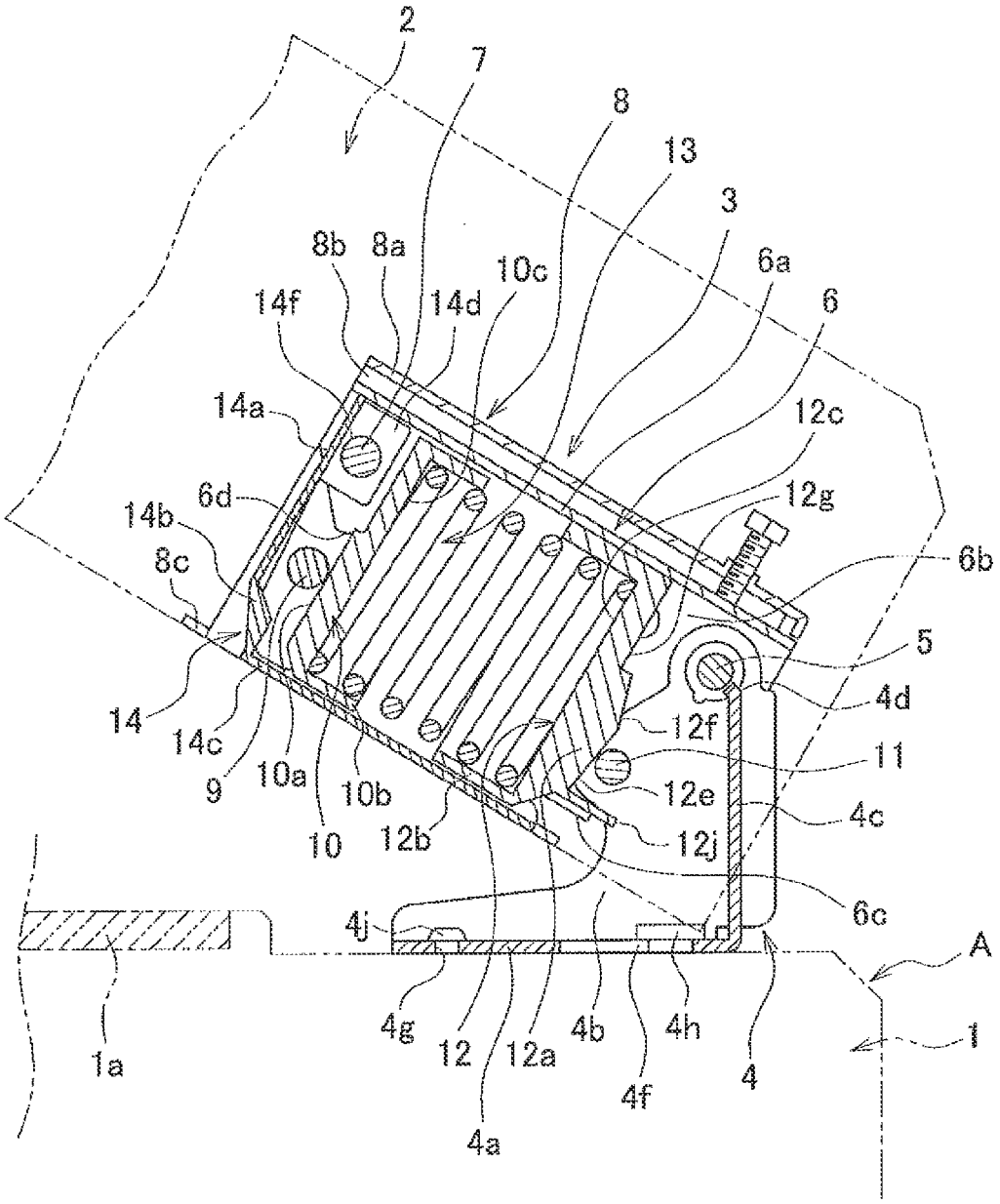
FIG. 9 is a side sectional view of an original cover closer as shown in FIG. 8.
Figure 10:
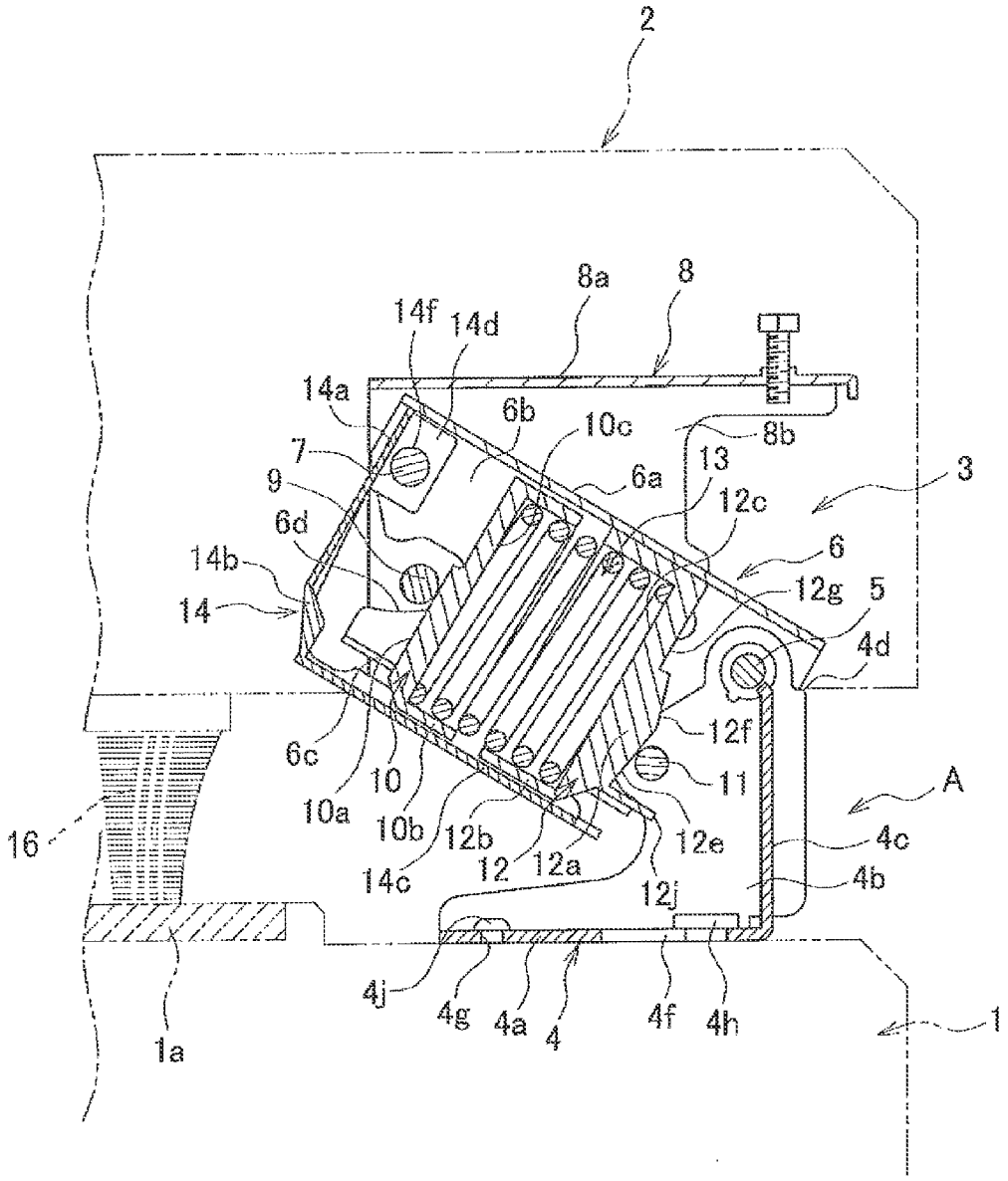
FIG. 10 is a side sectional view showing an original cover closer according to the present invention as is used.
Figure 11:
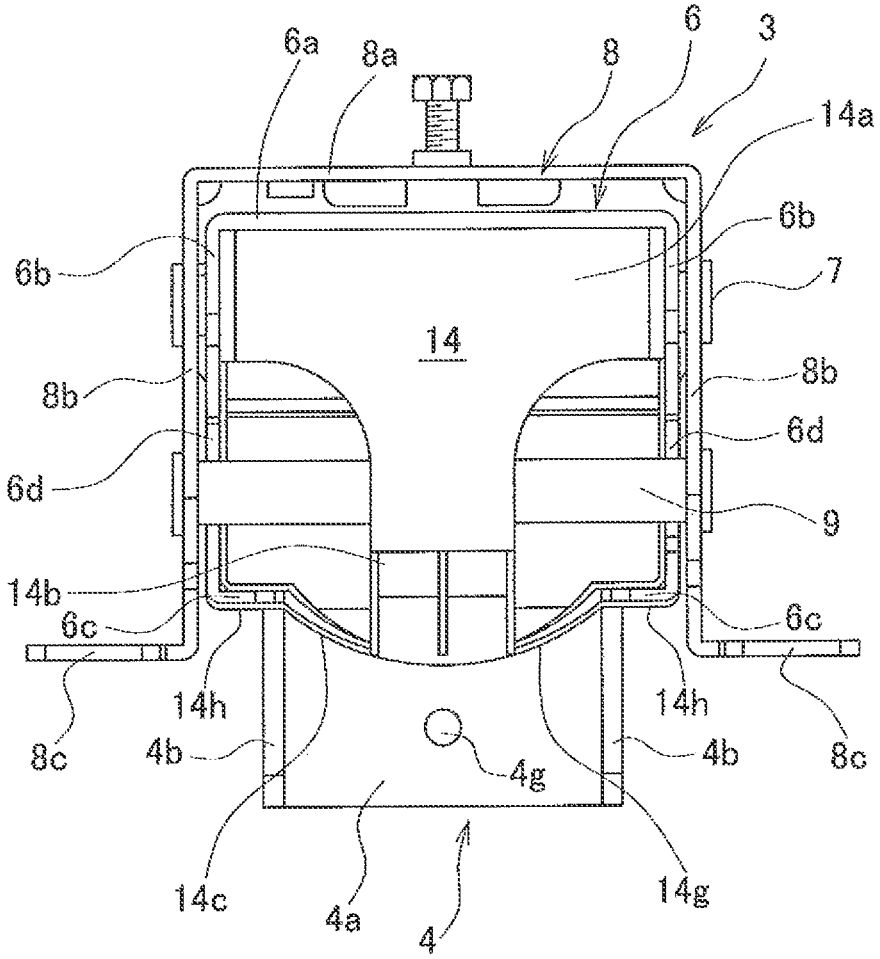
FIG. 11 is a plan view of an original cover closer according to the present invention.

In other words, a cover member 14 as above described is attached to a second hinge pin 7, particularly as shown in FIG. 5, when both side plates 6*b*, 6*b* of a supporting member 6 are coupled to both side plates 8*b*, 8*b* of a lifting member 8 by inserting the second hinge pin 7 through each of through holes 6*e*, 6*e* and each of through holes 8*d*, 8*d*. Thus once the cover member is attached to the second hinge pin, edges of attaching pieces 14*d*, 14*d* abut against an inner surface (as assembled) of an upper plate 6*a* of the supporting member 6, particularly as shown in FIGS. 7, 9, and 11. In this manner, the cover member 14 is attached to the second hinge pin 7, wherein the cover member as attached does not wobble and is thus stable.

Therefore, it is not necessary to fix a third cover portion 14*c* to holding pieces 6*c*, 6*c* of a supporting member 6, which now allows us to omit fixing means for this purpose, i.e. attaching screws and others, so that a smooth slide movement between a first slider 10 and a second slider 12 is no more blocked. A cover member 14 is contrived in the above-mentioned manner. Still further, the third cover portion 14*c* comprises a curved cover portion 14*g* covering a curved portion 10*b* of the first slider 10 and a curved portion 12*b* of the second slider 12, as well as the outer circumference of a compression coil spring 13, and cover pieces 14*h*, 14*h* extending from both ends of the curved cover portion 14*g* to cover the holding pieces 6*c*, 6*c*.

Figure 6:
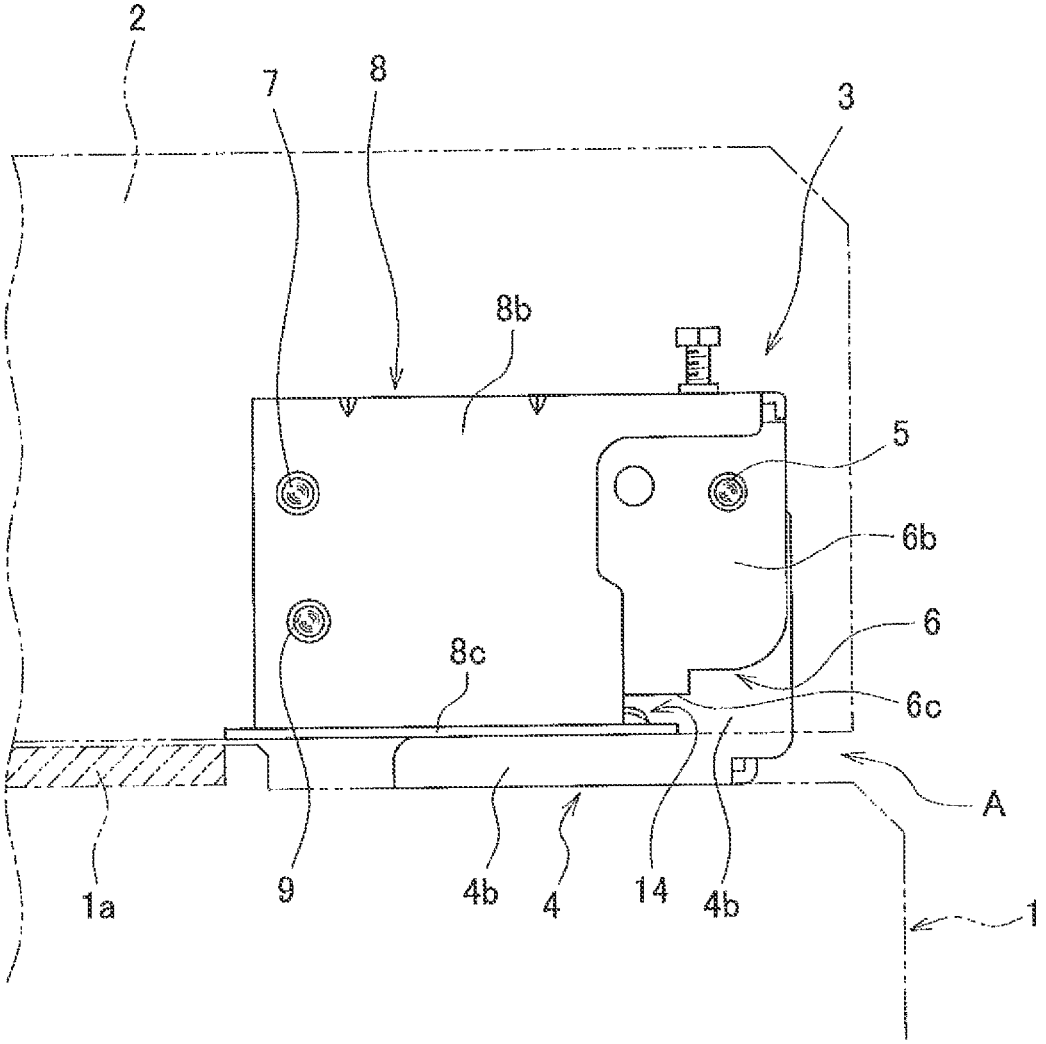
FIG. 6 is a side view showing an original cover closer according to the present invention as is used.

Accordingly, as shown in FIGS. 6 and 7, when the original cover 2 is closed on the contact glass 1*a*, a cover member 14 ensures that a first cover portion 14*a* covers parts of a top of a first slider 10 and an actuating member 9 to which grease and oil are applied, and a second cover portion 14*b* and a third cover portion 14*c* cover parts of the first slider 10, a compression coil spring 13 and a second slider 12, which are exposed to the outside.

Therefore, whether an original placed on a contact glass 1*a* is thinner or thicker, it is never smeared with grease and oil as applied onto an actuating member 9, a first slider 10, a second slider 12 and a compression coil spring 13. Moreover, a guard member 12*j* covers a space around a pressure bearing member 11, and in particular toward a contact glass 1*a*, when an original cover 2 is closed.

Figure 12:
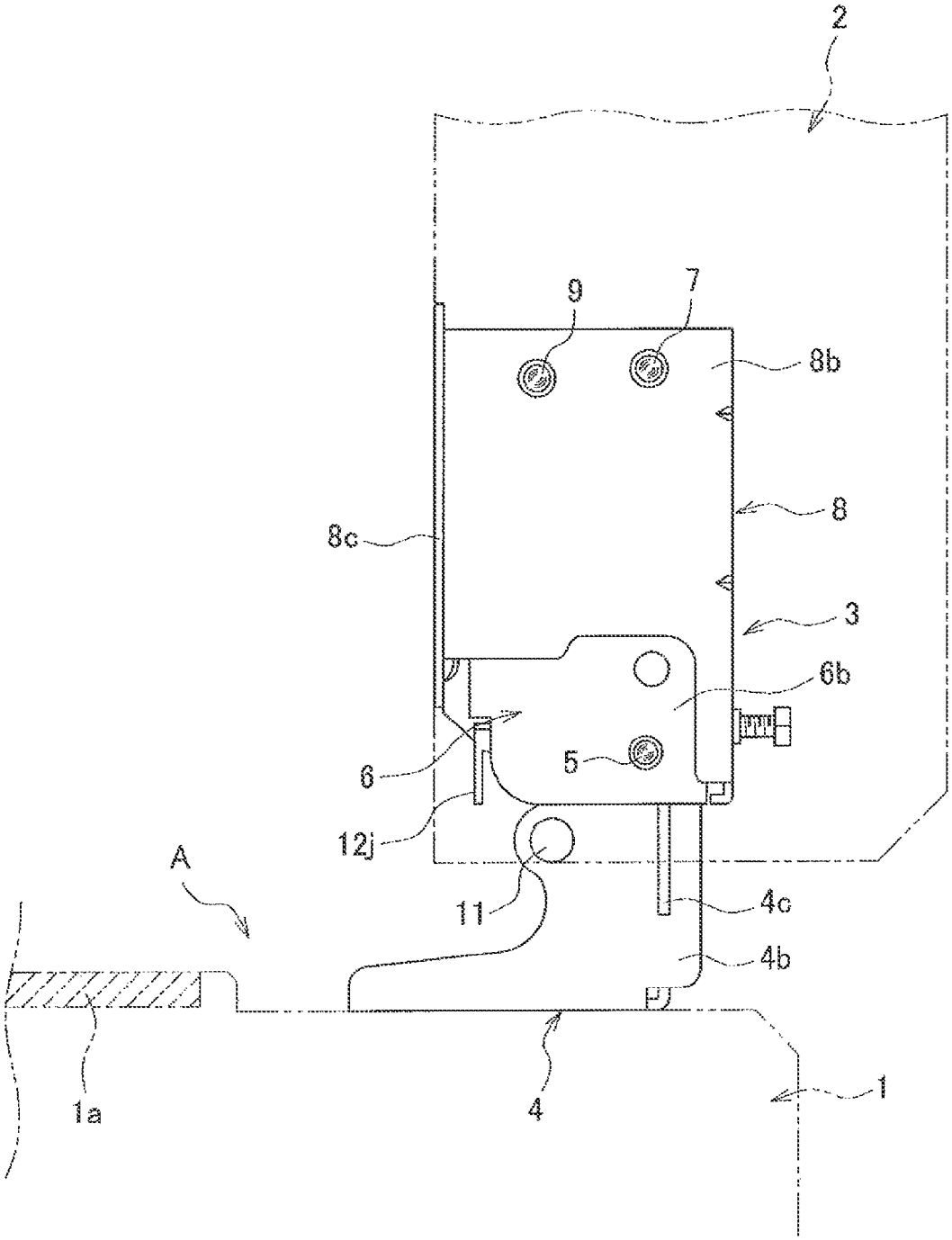
FIG. 12 is a side view showing an original cover closer according to the present invention as is used.
Figure 13:
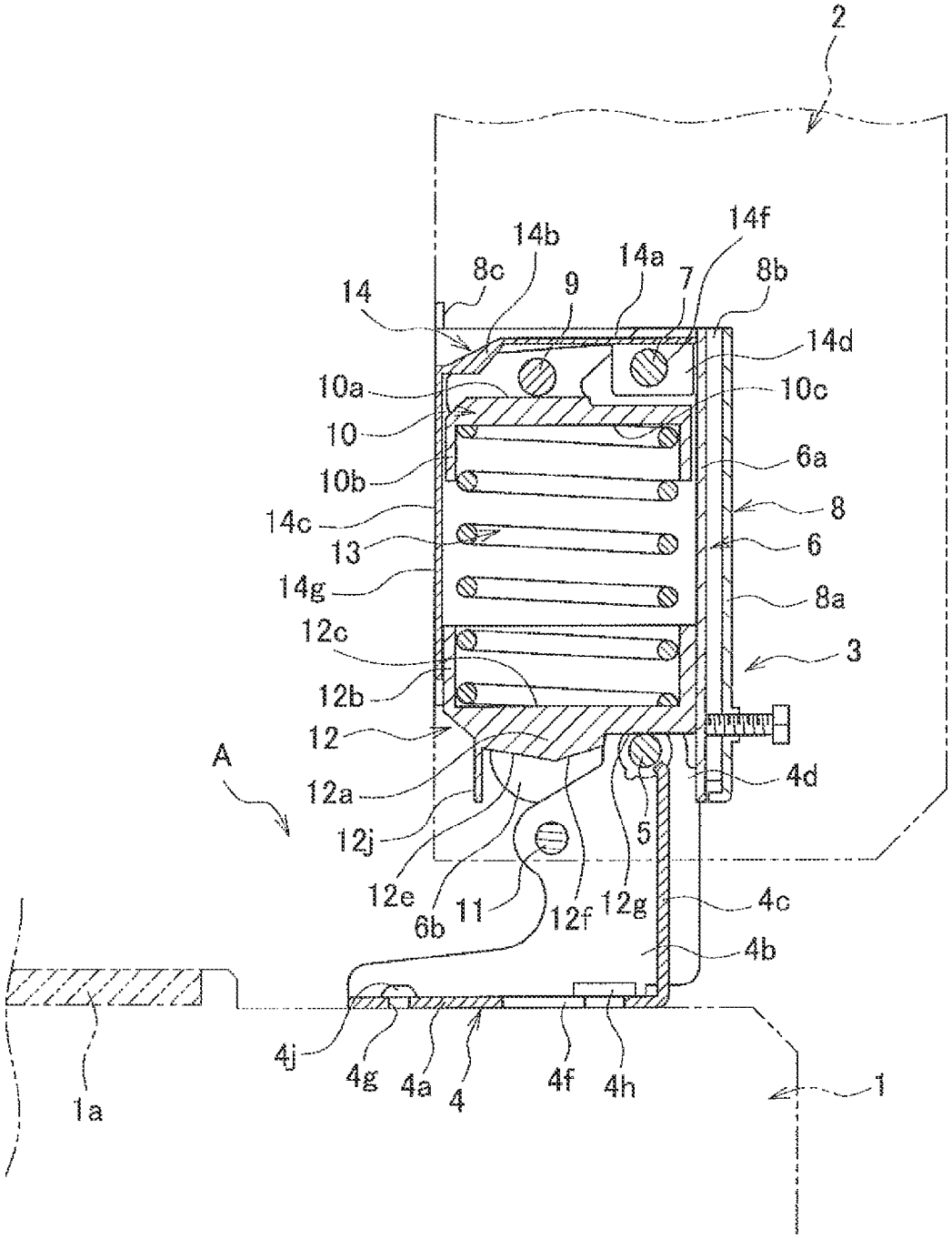
FIG. 13 is a side sectional view showing an original cover closer according to the present invention as shown in FIG. 12.
Figure 14:
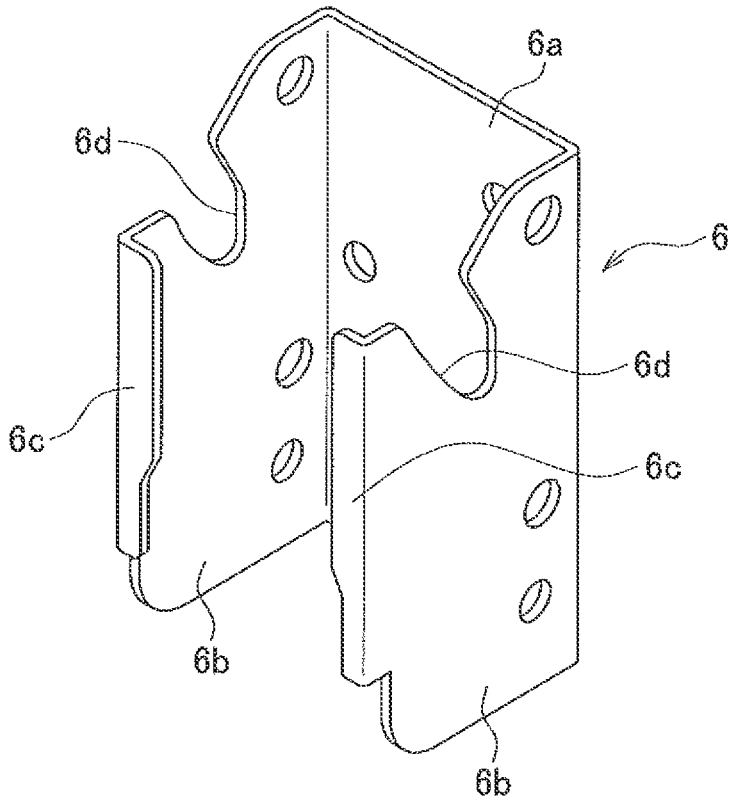
FIG. 14 is a perspective view of a supporting member an original cover closer according to the present invention.
Figure 15A:
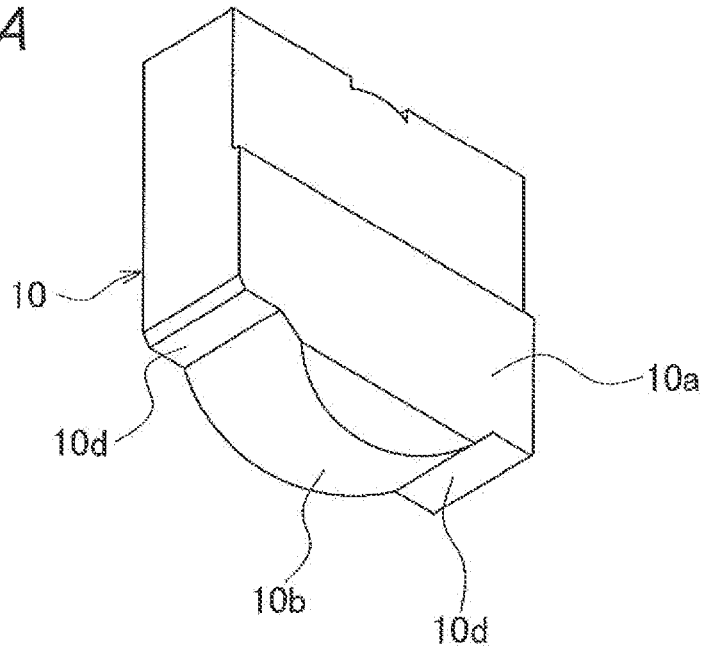
FIG. 15A is a perspective view of a first slider of an original cover closer according to the present invention, as viewed from the top.
Figure 15B:
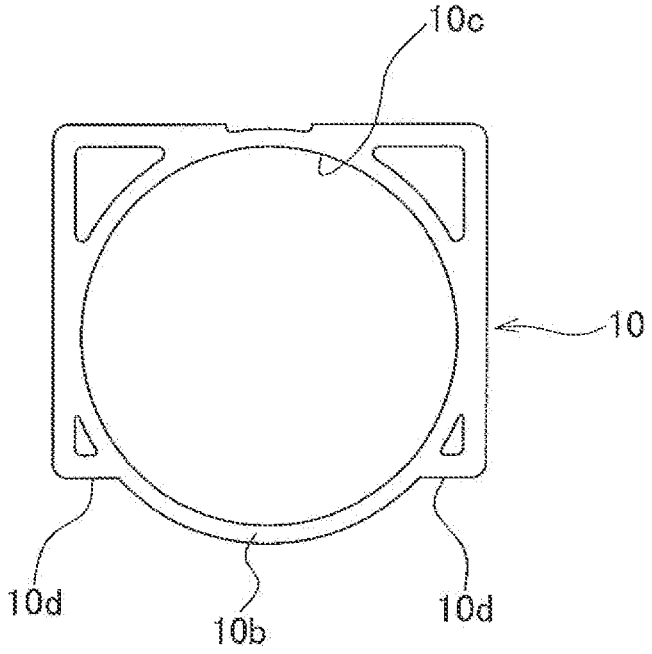
FIG. 15B is a perspective view of a first slider of an original cover closer according to the present invention, as viewed from the bottom.
Figure 16A:
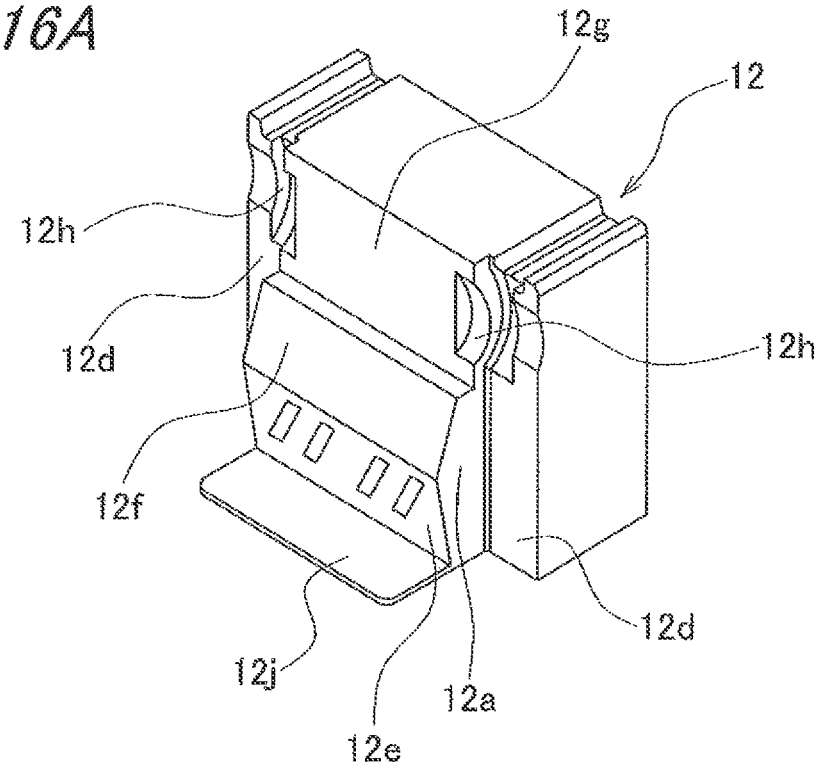
FIG. 16A is a perspective view of a second slider of an original cover closer according to the present invention, as viewed from the bottom.
Figure 16B:
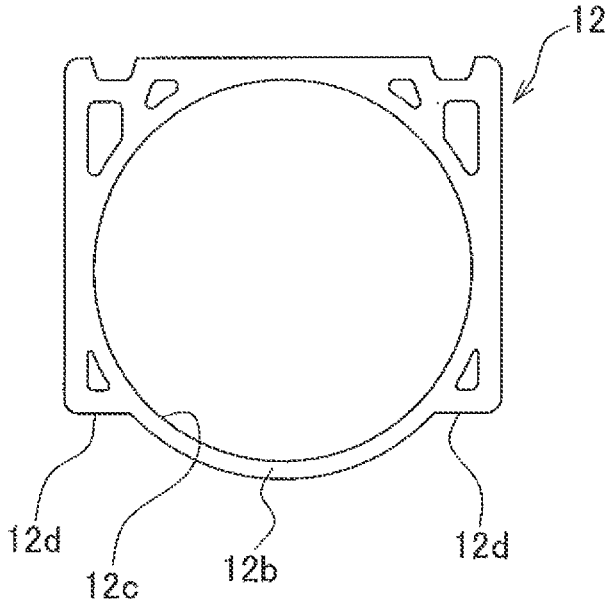
FIG. 16B is a perspective view of a second slider of an original cover closer according to the present invention, as viewed from the top.

When the original cover 2 is opened from the closed state as above described in a direction in which the original cover 2 is spaced apart (i.e. an opening direction), with a first hinge pin 5 being a supporting point and a section on the front side being held by hands, the area of the second slider 12 abutting against the pressure bearing member 11 gradually slides in the descending direction of the upward inclined portion 12*e*, while the second slider 12 slides inside the supporting member 6 toward the pressure bearing member 11 by the force of the compression coil spring 13, so that the compression coil spring 13 is gradually extended. At the maximum opening angle (about 90°) as shown in FIGS. 12 and 13, the recessed flat portion 12*g* is in contact with the first hinge pin 5 to serve as a stopper for the second slider, and the upper plate 6*a* of the supporting member 6 abuts against the stopper portions 4*d*, 4*d* of the attaching member 4, in order to prevent the original cover 2 from further opening.

As shown in FIGS. 8 to 13, the cover member 14 covers the areas exposed to the outside, i.e. the areas on the surface side of the second hinge pin 7, the actuating member 9, the first slider 10, the compression coil spring 13 and the second slider 12. The cover member 14 executes such covering function the entire range of opening or closing angle, so that points such as the areas of the second hinge pin 7, the actuating member 9, the first slider 10, the compression coil spring 13 and the second slider 12, come in direct contact with the original, as placed on the contact glass 1*a*, and therefore the original is prevented from being stained with grease or oil. Moreover, when the original cover 2 is first installed on the main body 1, or when the former is detached from the latter or attached to it for repair works, maintenance or inspection, the original cover closer 3 should be sometimes held by hands for such works. Also in such a situation, the cover member 14 prevents hands from being smeared with grease or oil.

Still further, the original cover closer 3 according to the invention enables the original to stably lie on the contact glass 1*a*, regardless of its thickness, and ensures that the original cover can horizontally cover the upper surface of the contact glass 1*a*. Namely, reference is made to the case that the original is a thick original 16 like a book as shown on FIG. 10: when the original cover 2 is opened, the end of the thick original 16 is placed on the contact glass 1*a* and then the original cover 2 is closed again, the end of the thick original 16 comes into contact with the lower surface of the supporting member 6. When the original cover 2 is pressed from that point further in the closing direction, the lifting member 8 is reversed via the actuating member 9 against the resilient force of the compression coil spring 13, and such a movement ensures that the original cover 2 can cover the upper surface of the contact glass 1*a* in a horizontal position. At that point, the actuating member 9 rotating around the second hinge pin 7 being a supporting point is fit into the guide grooves 6*d*, 6*d* provided on the both side plates 6*b*, 6*b* of the supporting member 6, allowing for reversal of the lifting member 8. Still further, the lifting member 8 is reversed via the actuating member 9 as above described, so that the copying surface of the thick original 16 is crimped to the contact glass 1*a* in a horizontal position, and that such a layout prevents the external light from entering through of the contact glass 1*a* into the interior of the main body to keep the copied image from being unclear.

Embodiment 2

Figure 17:
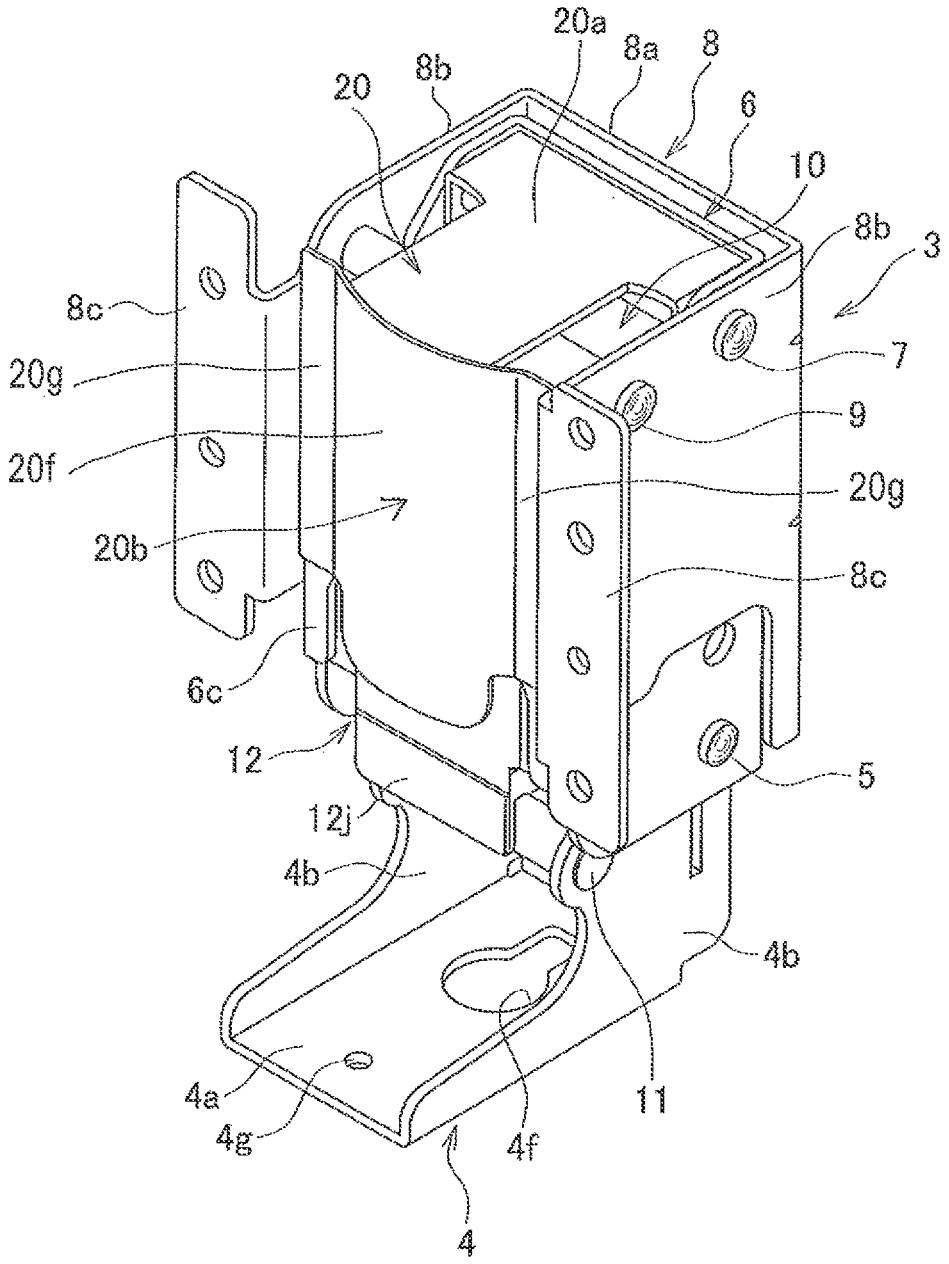
FIG. 17 is a perspective view showing another embodiment of an original cover closer according to the present invention.
Figure 18:
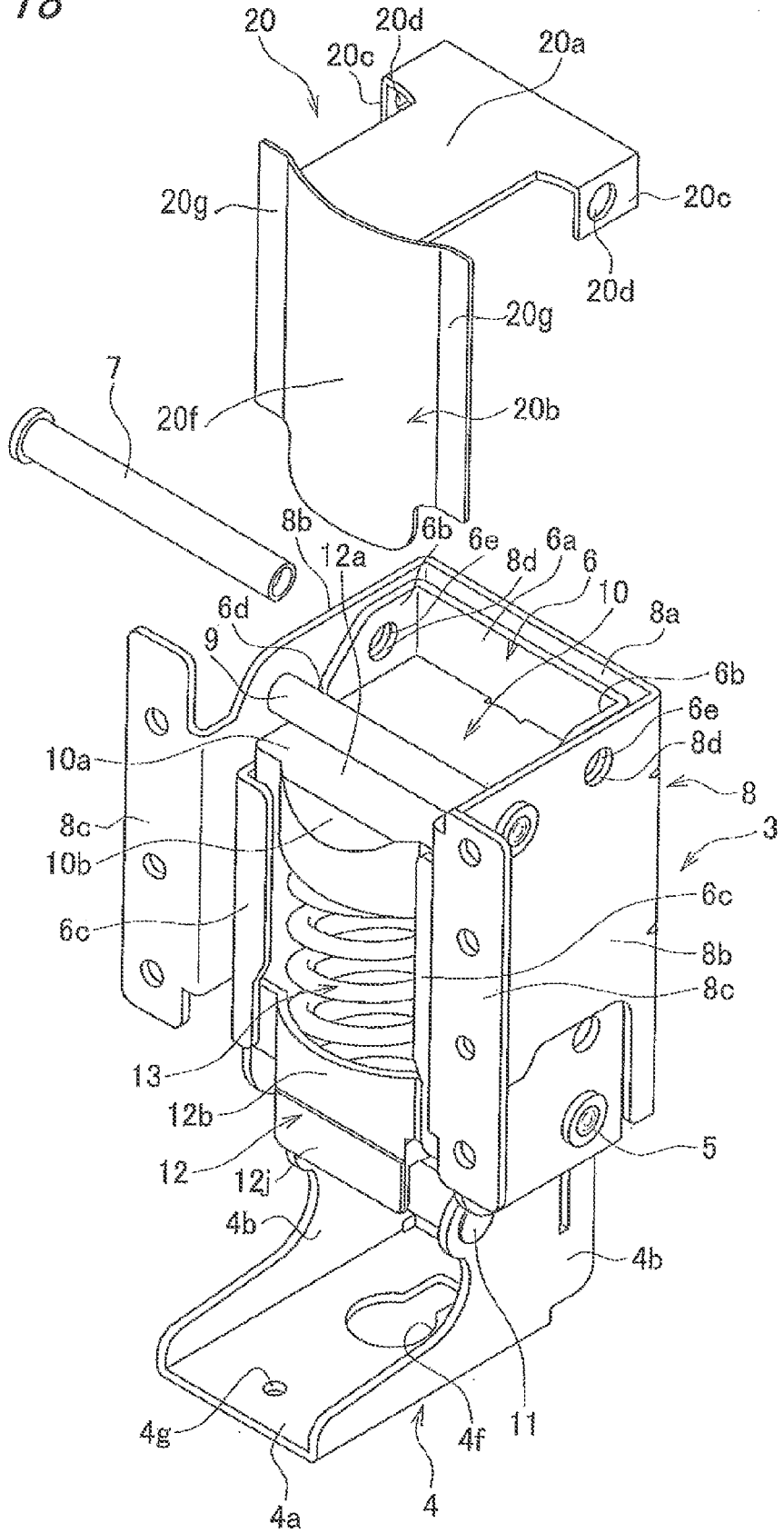
FIG. 18 is a partial exploded perspective view of an original cover closer according to the present invention as shown in FIG. 17.

FIGS. 17 and 18 show another embodiment of a cover member. According to the drawings, a cover member 20 according to Embodiment 2 comprises a first cover portion 20*a* covering a part on the side of an upper portion of a first slider 10, and a second cover portion 20*b* formed by folding a part of the first cover portion 20*a* substantially perpendicular to the latter. The cover member 20 is assembled by attaching pieces 20*c*, 20*c* provided with attaching holes 20*d*, 20*d* and formed by folding a part of the both sides of the first cover portion 20*a* to a second hinge pin 7. The rest of the components, such as a curved cover portion 20*f* and cover pieces 20*g*, 20*g*, are identical to the corresponding components of Embodiment 1. The cover member 20 is attached to the second hinge pin 7 with edge portions of the attaching pieces 20*c*, 20*c* being in contact with a lower surface of a top surface 6*a* of a supporting member 6, as shown in FIGS. 7, 9, 10, 11 and 13. In this manner, the cover member 20 is attached to the second hinge pin 7 without wobbling due to the attaching pieces 20*c*, 20*c*.

A cover member 20 according to Embodiment 2 as above described has a constricted part of a first cover portion 20*a*, which is wider than a corresponding part of a first cover portion 14*a* according to the Embodiment 1, so that the first cover portion 20*a* cover a wider area of the part exposed to the outside, thus further improving a function of preventing smears of grease on the original, as well as aesthetic effects on the appearance of an original cover closer 3.

In the meantime, an original cover closer 3 according to Embodiment 2 is substantially identical to that of Embodiment 1, so description is omitted for the rest of the components. In addition, in the original cover closer 3 according to Embodiment 1 or 2, a cover member 14 or 20 can be fixed to the upper plate 6*a* or both side plates 6*b*, 6*b* of a supporting member 6, through welding, attaching screws and rivet pins.

Embodiment 3

A cover member according to the present invention is also applicable to an original cover closer of conventional layout, as is described e.g. in JP Laid-Open Patent Application No. 2008-224704: it comprises an attaching member comprising a bottom plate, a leg portion hanging down to a direction perpendicular to the bottom plate and capable of being inserted into an attaching hole provided on a main body, such that the leg portion is detachable from the attaching hole and attachable to the latter, and both side plates erected from both sides of the bottom plate; a supporting member comprising an upper plate, a top plate provided on one end of the upper plate, both side plates provided perpendicular to both sides of the upper plate, wherein the supporting member is assembled by rotatably coupling its both side plates to the both side plates of the attaching member via a hinge pin; a pressure bearing member provided between the both side plates of the attaching member; a slider in contact with the pressure bearing member, wherein the slider is housed between the both side plates of the supporting member, such that the slider is slidable; and a compression coil spring housed inside the supporting member and resiliently provided between the slider and the top plate, wherein a cover member is so fixedly provided in the supporting member that the cover member covers at least a part of the slider exposed to the outside and a part of the compression coil spring exposed to the outside. Even by assembling the original cover closer as above described, the object of the present invention is achieved.

The present invention enables a cover member to cover parts exposed to the outside which belong to the components such as a first cam slider, a second cam slider, an actuating member, a pressure bearing member and a compression coil spring, and to which grease and others are applied. Therefore, the present invention very effectively prevents the end of the original from smears of grease and others, and further the above-mentioned components damaging aesthetics in appearance from exposure to the outside. Thus the present invention is suitable in use for an original cover closer of office equipment, such as copying machine and multifunctional device.

What is claimed is:

1. An original cover closer for supporting an original cover of office equipment on a main body, said original cover being openable and closable with respect to said main body, said original cover closer comprising:

an attaching member comprising a bottom plate attached to the main body of office equipment and both side plates erected from both sides of the bottom plate;

a supporting member comprising an upper plate, both side plates provided to hang down perpendicular to both sides of said upper plate, and holding pieces provided by inwardly folding respective sections of said both side plates, said supporting member being assembled by rotatably coupling both side plates thereof to the both side plates of the attaching member via a first hinge pin;

a lifting member for being attached to said original cover, said lifting member comprising an upper plate and both side plates provided to hang down perpendicular to both sides of said upper plate, said both side plates of said lifting member being coupled to the free end side of said supporting member via a second hinge pin, such that said lifting member is rotatable in a direction opposite to the direction in which said supporting member rotates;

a pressure bearing member provided between the both side plates of the attaching member;

a second slider in contact with said pressure bearing member, said second slider being held by said holding pieces and housed between said both side plates of said supporting member, such that said second slider is slidable;

an actuating member attached to the side on which said both side plates of said attaching member rotate via said second hinge pin;

a first slider in contact with said actuating member, said first slider being held by said holding pieces and housed between the both side plates of said supporting member, such that said first slider is slidable; and a compression coil spring resiliently provided between the first slider and the second slider, a cover member being fixed to said supporting member, for covering at least in part areas of said actuating member, said first slider and said second slider which are exposed to the outside, as well as that of said compression coil spring which is exposed to the outside.

2. An original cover closer according to claim 1, wherein attaching pieces are provided on both sides of said cover member in order to fix said cover member to said supporting member, and said attaching pieces are attached to said second hinge pin, edge portions of said attaching pieces being in contact with a lower surface of an upper plate of said supporting member.

3. An original cover closer according to claim 1, wherein said cover member is configured such that it is attached to said upper plate or said both side plates of said supporting member through welding, attaching screws and rivet pins.

4. An original cover closer according to claim 1, wherein said cover member comprises a first cover portion covering a part on the side of an upper portion of said first slider and a part on the side of an upper portion of said second hinge pin, a second cover portion raised from the first cover portion and formed by folding a part of the first cover portion about 45°, a third cover portion raised from said second cover portion and formed by folding a part of said second cover portion about 90° relative to said first cover portion, and attaching pieces formed by folding both end portions of said first cover portion, said attaching pieces being attached to said second hinge pin.

5. An original cover closer according to claim 1, wherein said cover member comprises a first cover portion covering a part on the side of an upper portion of said first slider, a second cover portion formed by folding a part of the first cover portion substantially perpendicular to the first cover portion, said second cover portion covering said compression coil spring, as is exposed to the outside from between said holding pieces, as well as from between said first slider and said second slider, and attaching pieces formed by folding both end portions of said first cover portion, said attaching pieces being attached to said second hinge pin.

6. Office equipment wherein an original cover comprising an original cover closer according to claim 1 is used.

7. An original cover closer for supporting an original cover of office equipment on a main body, said original cover being openable and closable with respect to said main body, said original cover closer comprising:

an attaching member comprising a bottom plate, a leg portion hanging down to a direction perpendicular to said bottom plate and capable of being inserted into an attaching hole provided on said main body, such that said leg portion is detachable from said attaching hole and attachable to the latter, and both side plates erected from both sides of said bottom plate;

a supporting member comprising an upper plate, a top plate provided on one end of said upper plate, both side plates provided to hang down perpendicular to both sides of said upper plate, and holding pieces provided by inwardly folding respective sections of said both side plates, said supporting member being assembled by rotatably coupling both side plates thereof to said both side plates of said attaching member via a hinge pin;

a pressure bearing member provided between said both side plates of said attaching member;

a slider in contact with said pressure bearing member, said slider being housed between said both side plates of said supporting member, such that said slider is slidable; and a compression coil spring housed inside said supporting member and resiliently provided between said slider and said top plate, a cover member being so fixedly provided in said supporting member that said cover member covers at least a part of said slider exposed to the outside and apart of the compression coil spring exposed to the outside.

8. Office equipment wherein an original cover comprising an original cover closer according to claim 7 is used.

* * * * *